US007878783B2

(12) United States Patent
Kunz

(10) Patent No.: US 7,878,783 B2
(45) Date of Patent: Feb. 1, 2011

(54) GEAR PUMP WITH COMPONENTS CONSTRUCTED AS A HOMOGENOUS WORKPIECE

(75) Inventor: Wolfgang Kunz, Muennerstadt (DE)

(73) Assignee: Fresenius Medical Care Deutschland GmbH, Bad Homburg (DE)

( * ) Notice: Subject to any disclaimer, the term of this patent is extended or adjusted under 35 U.S.C. 154(b) by 300 days.

(21) Appl. No.: 11/990,922

(22) PCT Filed: Jun. 9, 2006

(86) PCT No.: PCT/EP2006/005519

§ 371 (c)(1),
(2), (4) Date: Feb. 25, 2008

(87) PCT Pub. No.: WO2007/028429

PCT Pub. Date: Mar. 15, 2007

(65) Prior Publication Data

US 2009/0155115 A1 Jun. 18, 2009

(30) Foreign Application Priority Data

Sep. 2, 2005 (DE) ..... 10 2005 042 040

(51) Int. Cl.
*F04C 18/00* (2006.01)
*F04C 2/00* (2006.01)

(52) U.S. Cl. ..... 418/206.9; 418/152; 418/179; 418/206.1; 418/206.7

(58) Field of Classification Search ..... 418/206.1, 418/206.5–206.9, 152, 178, 179
See application file for complete search history.

(56) References Cited

U.S. PATENT DOCUMENTS

| | | | | | |
|---|---|---|---|---|---|
| 2,302,966 | A | * | 11/1942 | MacNeil et al. | 418/206.6 |
| 3,133,506 | A | * | 5/1964 | Luciani | 418/206.7 |
| 4,087,216 | A | * | 5/1978 | Shumate | 418/131 |
| 4,583,924 | A | * | 4/1986 | Zenglein et al. | 418/206.9 |
| 6,158,997 | A | | 12/2000 | Post | |
| 6,612,821 | B1 | | 9/2003 | Kuijpers et al. | |

FOREIGN PATENT DOCUMENTS

| | | | | | |
|---|---|---|---|---|---|
| DE | 2409554 | A | * | 9/1975 | |
| DE | EP 0 147 562 | A2 | | 7/1985 | |
| DE | EP 0 962 656 | A2 | | 12/1999 | |
| DE | 199 15 784 | A1 | | 10/2000 | |
| EP | 147567 | A2 | * | 10/1985 | 418/206.9 |
| FR | EP 1 055 819 | A1 | | 11/2000 | |

* cited by examiner

*Primary Examiner*—Theresa Trieu
(74) *Attorney, Agent, or Firm*—Jacobson Holman PLLC

(57) ABSTRACT

A gear pump has two engaging gearwheels disposed between a suction chamber and a pressure chamber, with the gearwheels borne on bearing axles that are connected to the gearwheels. The gearwheels and the bearing axles are each manufactured of the same material as a homogenous workpiece. This provides for both simple construction of the gear pump and good pump operating properties. Preferably the gearwheels and bearing axles are made of a synthetic material.

8 Claims, 2 Drawing Sheets

GEAR PUMP WITH COMPONENTS CONSTRUCTED AS A HOMOGENOUS WORKPIECE

CROSS-REFERENCE TO RELATED APPLICATION

This is a national stage of International Application No. PCT/EP2006/005519 filed on Jun. 9, 2006 and published in German.

BACKGROUND OF THE INVENTION

1. Field of Invention

The invention relates to the field of gear pumps.

2.Description of the Prior Art

Gear pumps are used in a wide variety of fields. In pumps of this type two gearwheels usually engage so that they always rotate in opposite directions when in operation. If the surfaces of the gearwheels are bounded by walls and if a first space is defined around the engaging gearwheels and a second space around the disengaging gearwheels, the suction effect starting in the first space and the pressure effect in the second space can be utilised to move a medium located in the spaces.

Gear pumps have the advantage of having only a few components and can therefore be manufactured relatively simply. For example, the pumps can be driven in a non-contact manner by way of a magnetic coupling which benefits the separation of the fluid to be moved from other machine components. Due to the generally present direct connection of the suction and pressure space with a certain by-pass cross-section area these pumps can be used without problems, particularly in areas in which process-related occlusions frequently occur in the fluid inlet and/or outlet pipes.

EP 0 147 562 A2 and DE 199 15 784 A1 disclose a gear pump in which two gearwheels borne on separate axles are inserted between a first and a third of a total of three plates of a pump body. The second plate located between the first and the third plate has recesses for the gearwheels as well as the suction and pressure space. The inlet to the suction space, and the outlet from the pressure space are also in the second plate. The gearwheels are fitted in a rotating manner on the axles designed as rigid pegs.

In the known pumps the bearing axles are made of a different material from the gearwheels. Whereas, for example, the gearwheels can be made of synthetic material, the bearing axles consist of much stronger materials such as metal or ceramic. The gearwheels are sprayed or pressed onto the relevant bearing axle if the bearing axles are to be rotatable. The slide bearing sleeves required in this case must in turn be made of a material which is softer than the bearing axles.

However, the known gear pumps are costly to manufacture. Spraying on requires an additional handling system which inserts the bearing axles into the spraying tool. A further operating stage is also required for the pressed on variant, which results in additional costs. The positioning tolerance of several components also has to taken into account.

SUMMARY OF THE INVENTION

The aim of the invention is therefore to provide a gear pump which is less costly to manufacture. The aim is achieved by way of a gear pump with the features described herein. Other advantageous embodiments of the invention are also described herein.

The invention is based on the observation that the manufacture of a gear pump of the type in question can be simplified by manufacturing both gearwheels and the bearing axles connected to them of the same material as one homogenous workpiece in a common manufacturing process. Thus, the gearwheels and bearing axles can be made of synthetic material by way, for example, of injection moulding. In this case the body itself can be used as the bearing for the axles, as a result of which additional bearing sleeves can be omitted. By dispensing with additional bearing sleeves undefined gaps, which can occur behind the sleeve, are avoided. This applies equally to gaps which could occur between the gearwheels and rigid axles. Avoiding such gaps is important, particularly when used in medical technology equipment in which flushing of poorly accessible spaces is aimed for.

Finally from the point of view of synthetic materials it is important to inject an external surface, such as that of the axles to measure instead of having to produce accurately the current boring in the slide bearing sleeve.

The invention will be described in more detail below with the aid of an example of the embodiment shown in the drawings.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
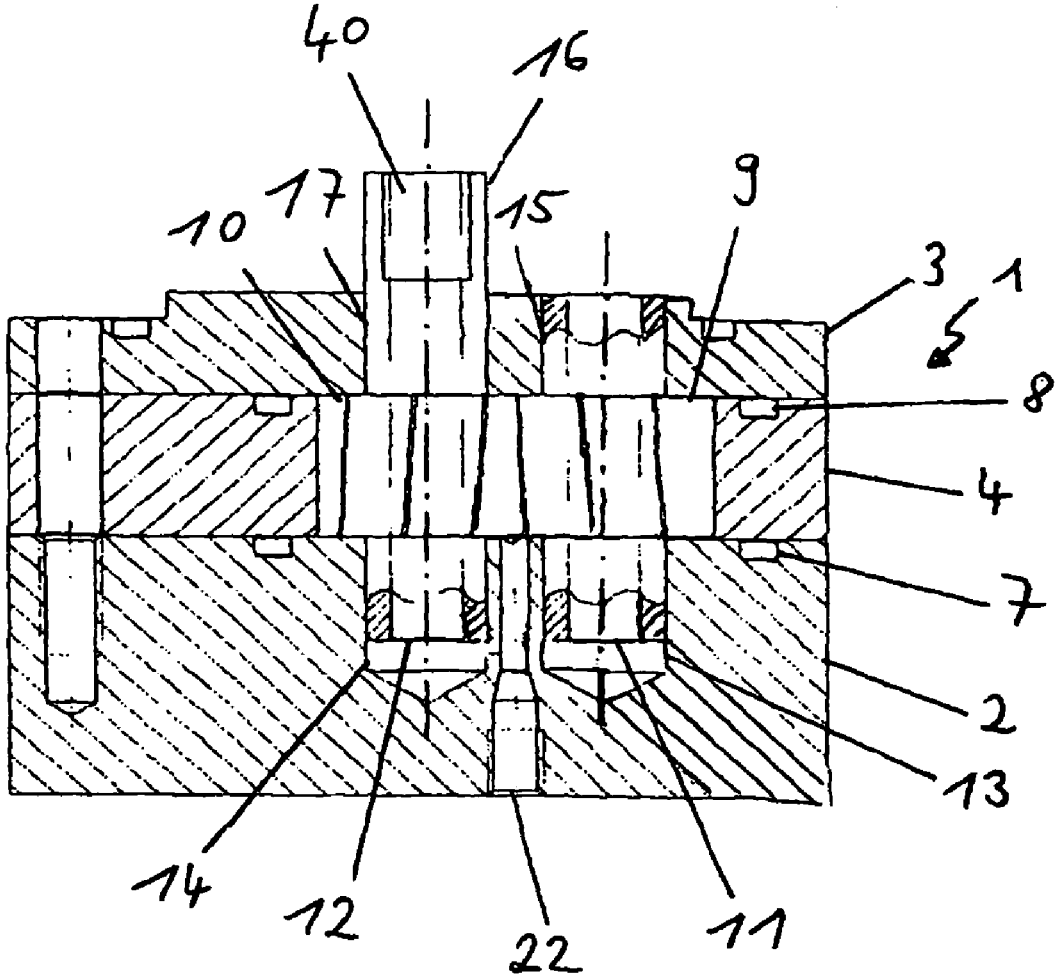
FIG. 1 is a cross-sectional view of a gear pump constructed in accordance with an embodiment of the present invention.

FIG. 1 shows a cross-section through an example of embodiment of the gear pump in accordance with the invention. In parts the structure resembles the pump shown in DE 199 15 784 A1, the disclosure of which is explicitly referred to for the present application. Therefore, for the sake of simplicity the identical components are given the same reference number in this application as in DE 199 15 784 A1.

The gear pump has a casing body 1 which contains a first plate 2 and a third plate 3, between which a ring-shaped second plate 4 is arranged. The casing parts 2, 3 and 4 are firmly connected to each other by means of screws, which are not illustrated. To seal the casing parts sealing rings are provided which lie in the grooves 7 and 8 on the inner sides of the first and second and/or the second and third facing each other.

The second plate 4 surrounds a pump chamber for accommodating two gearwheels 9, 10. According to the invention the gearwheels are connected in one piece with the bearing axles 11, 12, whereby the axles and the gearwheels are manufactured as a homogenous workpiece of the same material, i.e. the gearwheel 9 and the bearing axle 11 as well as the gearwheel 10 and the bearing axle 12 each constitute a common workpiece. However, for the following explanation of the function the gearwheels continue to be denoted with separate reference numbers.

The bearing axles 11, 12 project from the gearwheels 9, on both sides. The axles are designed as hollow axles whereby the hollows can be used for supplying coolants and lubricants.

The projecting parts of the bearing axles 11, 12 are borne as slide bearings in a rotating manner in bearing borings 13, 14, 15 and 17. The bearing axles and gearwheels are preferably made of synthetic material. Both gearwheels can thereby be produced together with their bearing axles by injection moulding in a common manufacturing stage. It is also conceivable for some of the bearing points to be implemented differently. For example, boring 17 can be wider and a second bearing of axle 12 of gearwheel 10 be realised outside the casing body shown in the drawing. It is also conceivable for one or both of the gearwheels to be borne by the bearing axles on only one side of the gearwheel. Here, in one or both of the gearwheels, the bearing axle can project on only one side of the gearwheels.

Figure 2:
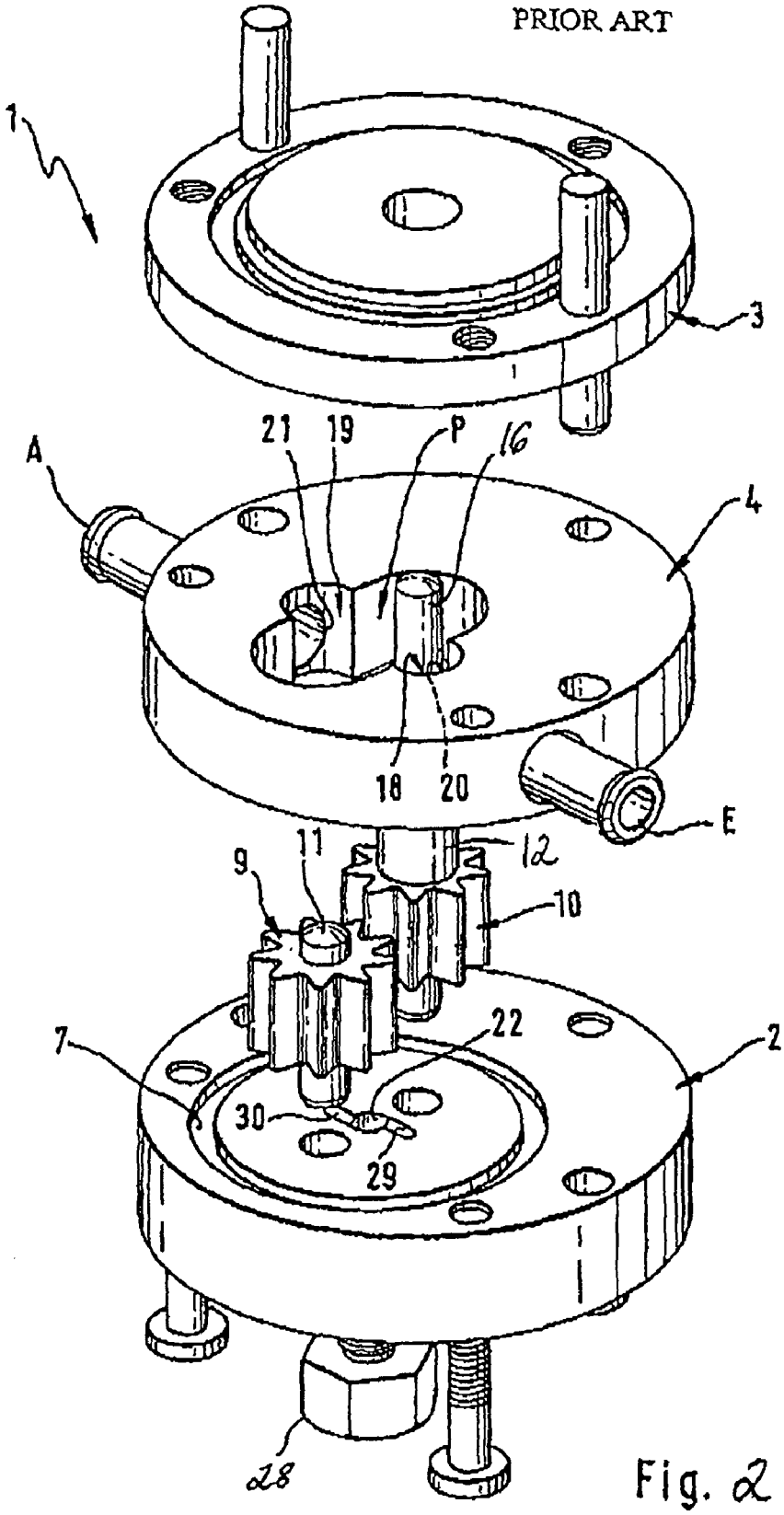
FIG. 2 is an exploded view of the gear pump shown in FIG. 1.

As shown in FIG. 2, in front of the two gearwheels 9, 10 there is a hollow space 19 which constitutes the suction chamber of the gear pump. The suction chamber is bounded radially and horizontally by the second plate 4 and axially and vertically by the first and third plate 2 and 3. In the second plate 4 there is also an inlet, which is shown, to the suction chamber 19 for sucking in a fluid to be moved. Behind the gearwheels there a second hollow space forming the pressure chamber 18 of the gear pump. The pressure chamber 18 is bounded in the same way as the suction chamber 19 by the plates of the casing body 1. From the pressure chamber 18 there is an outlet in the second plate 4 for emitting the fluid to be moved.

In the form of the embodiment shown in the drawings, the bearing borings 13 and 14, in first plate 2, with the width of the diameter of the bearing axles 11, 12 are deeper than the penetration depth of the bearing axles in order to allow free running of the bearing axles. Both bearing borings do not, however, pass through the first plate 2. In contrast to this the bearing borings 15 and 17 pass through the third plate 3. The axle 12 of the drive gearwheel 10 projects above the third plate 3 so that a projecting section 16 of the axle can be driven as a drive shaft via an external drive mechanism in order to operate the pump.

For better mechanical coupling the projecting section 16 of the drive shaft has two parallel, opposite flat notches, the normal vector of which runs perpendicularly to the shaft axle. In FIG. 1 the notch 40 can be seen from the top, while the second opposite notch is hidden by the axle. As a drive mechanism coupled magnets have been proven in practice which are operated by a variable external magnetic field via a magnetic coupling.

FIG. 1 also shows a boring 22 for an adjusting screw 28 (shown in FIG. 2). With the adjusting screw 28, the cross-sectional area of a by-pass channel, depicted in FIG. 2 as first slot 29 and second slot 30, which connects the suction and pressure chambers 19, 18 via the face of the gearwheels 9, 10, can be set in the way described in DE 199 15 784 A1. Adjustment allows calibration of the pumps, which otherwise would exhibit great differences in conveying performance as a result of unavoidable tolerance fluctuations.

Due to the design of the gear pump in accordance with the invention the manufacturing process of the gearwheels as well as the bearing axles and therefore of the overall pump is simplified. Also, no additional bearing sleeves for the slide bearing of the bearing axles are necessary. It has been shown that particularly in the case of manufacture of the bearing axles of synthetic material, when borne in borings of a harder material such as metal, sufficiently stable running properties are achieved. This overturns the usual bearing principle in which the bearing axle is made of a considerably harder material than the slide bearing sleeve.

The pump in accordance with the invention is particularly suitable for conveying aqueous media in a medical device, such as, for example, a dialysis machine.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A gear pump comprising:

two engaging gearwheels disposed between a suction chamber and a pressure chamber, the gearwheels being borne on respective bearing axles connected thereto, the gearwheels and the bearing axles each being constructed of a same synthetic material as a homogenous workpiece, and the bearing axles being borne, without additional bearing sleeves, in bearing holes of walls that bound the suction chamber and the pressure chamber, the walls of the bearing holes being constructed of a metal material that is harder than the synthetic material of the gearwheels and the bearing axles.

2. The gear pump in accordance with claim 1, wherein the gearwheels and the bearing axles have an injection molded construction.

3. The gear pump in accordance with claim 1, wherein the bearing axle of one of the gearwheels projects beyond the walls bounding the suction and pressure chambers to be driven as a drive shaft by an external drive mechanism for operating the gear pump.

4. The gear pump in accordance with claim 3, wherein a projecting part of the drive shaft has two parallel, opposite, and flat notches , a normal vector of the notches running perpendicularly to the shaft axis for coupling with the drive mechanism.

5. The gear pump in accordance with claim 1, wherein a body of the gear pump includes a first, a second, and a third plate, the gearwheels being inserted between the first plate and the third plate, which constitute the walls axially bounding the suction chamber and the pressure chamber, and the second plate being located between the first plate and the third plate, having recesses for the gearwheels, and radially bounding the suction chamber and the pressure chamber.

6. The gear pump in accordance with claim 5, wherein an inlet to the suction chamber and an outlet from the pressure chamber are located inside the second plate.

7. The gear pump in accordance with claim 5, further comprising, in the first plate or the third plate, a by-pass channel between the suction chamber and the pressure chamber, the cross-section of the by-pass channel being adjustable by an adjusting screw passing through the first plate.

8. The gear pump in accordance with claim 1, wherein the bearing axles are configured to be hollow.

* * * * *